US008191184B2

(12) United States Patent
Gibson et al.

(10) Patent No.: US 8,191,184 B2
(45) Date of Patent: Jun. 5, 2012

(54) DISPOSABLE NECK PILLOW FOR SHAMPOO BASIN

(75) Inventors: Kristina C. Gibson, Cincinnati, OH (US); Harry L Culver, Dunkirk, MD (US); Allison Wachendorfer, Carrollton, TX (US)

(73) Assignee: Re Ventures I, LLC, Cincinnati, OH (US)

( * ) Notice: Subject to any disclaimer, the term of this patent is extended or adjusted under 35 U.S.C. 154(b) by 0 days.

(21) Appl. No.: 12/656,067

(22) Filed: Jan. 14, 2010

(65) Prior Publication Data

US 2011/0099709 A1 May 5, 2011

(51) Int. Cl.
*A45D 44/10* (2006.01)

(52) U.S. Cl. ..... 4/523; 4/580

(58) Field of Classification Search ..... 4/523, 580
See application file for complete search history.

(56) References Cited

U.S. PATENT DOCUMENTS 2,948,903 A 8/1960 Gilmer
4,411,032 A 10/1983 Lewy
4,731,891 A * 3/1988 Scheurer et al. ..... 5/636
4,864,667 A 9/1989 Adams
5,152,023 A * 10/1992 Graebe ..... 5/655.3
5,239,711 A 8/1993 Tafur
5,393,297 A * 2/1995 Kristoff ..... 601/57
6,085,367 A * 7/2000 Guiste ..... 4/580
6,189,168 B1 * 2/2001 Graebe ..... 5/644
6,219,865 B1 * 4/2001 Stokesbary ..... 5/637
6,230,338 B1 * 5/2001 Kirsch ..... 4/523
6,239,338 B1 5/2001 Robinson
6,453,485 B2 * 9/2002 Bullock ..... 4/580
6,925,660 B1 * 8/2005 Cartwright ..... 4/523
7,039,962 B2 * 5/2006 Romfeld ..... 4/519
7,140,056 B2 11/2006 Deering

* cited by examiner

*Primary Examiner* — Gregory Huson
*Assistant Examiner* — Karen L Younkins
(74) *Attorney, Agent, or Firm* — Richard C. Litman

(57) ABSTRACT

The disposable neck pillow for a shampoo basin is formed from one or more bladders joined or otherwise positioned side-by-side to form a single cushioning pillow. Preferably, the bladders are filled with air. In a first embodiment, the neck pillow/pad has a top cover and a bottom cover. The top cover is fabricated from a suitable, soft, cloth-like fabric or material. The bottom cover is fabricated from a liquid impermeable or resistant material. The bottom and top covers are arranged to encapsulate the bladders. A layer of adhesive material may be disposed on the outer surface of the bottom cover to secure the pillow to the shampoo basin.

4 Claims, 5 Drawing Sheets

DISPOSABLE NECK PILLOW FOR SHAMPOO BASIN

CROSS-REFERENCE TO RELATED APPLICATION

This application claims the benefit of U.S. patent application Ser. No. 12/318,835 filed Jan. 9, 2009, which claims the benefit of U.S. Provisional Patent Application Ser. No. 61/006,553, filed Jan. 18, 2008.

BACKGROUND OF THE INVENTION

1. Field of the Invention

The present invention generally relates to cushions. More specifically, the present invention is drawn to a disposable, neck pillow for cushioning the neck of a user during a shampoo at a hair salon or the like.

2. Description of the Related Art

When shampooing a client at a hair salon, it is necessary to extend the client's head over a basin while wetting the hair, applying the shampoo, rinsing the hair, etc. During this process the client's neck must be supported. Towels often provide insufficient comfort, and may slip out of place. Durable pads are difficult to clean for use with multiple clients. Furthermore, shampoo basins are generally not cleaned after each use resulting in unclean basin surfaces.

Thus, a disposable neck pillow for a shampoo basin solving the aforementioned problems is desired.

SUMMARY OF THE INVENTION

In a preferred embodiment, the disposable neck pillow for a shampoo basin is formed from one or more bladders joined or otherwise positioned edge to edge to form a single cushioning pad. Preferably, the bladders are filled with air. However, it should be noted that other fluids or cushioning materials, such as foam, could be utilized, if suitable. In a first embodiment, the neck pillow/pad has a top cover and a bottom cover. The top cover is fabricated from a suitable, soft, cloth-like fabric or material. The bottom cover is fabricated from a liquid-impermeable or liquid-resistant material. The bottom and top covers are arranged to encapsulate the bladders. A layer of adhesive material may be disposed on the outer surface of the bottom cover to secure the pillow/pad to the shampoo basin. The adhesive material may be covered with a removable release liner, or the like, until the neck pillow/pad is used. The neck pillow is designed for single use, and may be disposed of after use.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
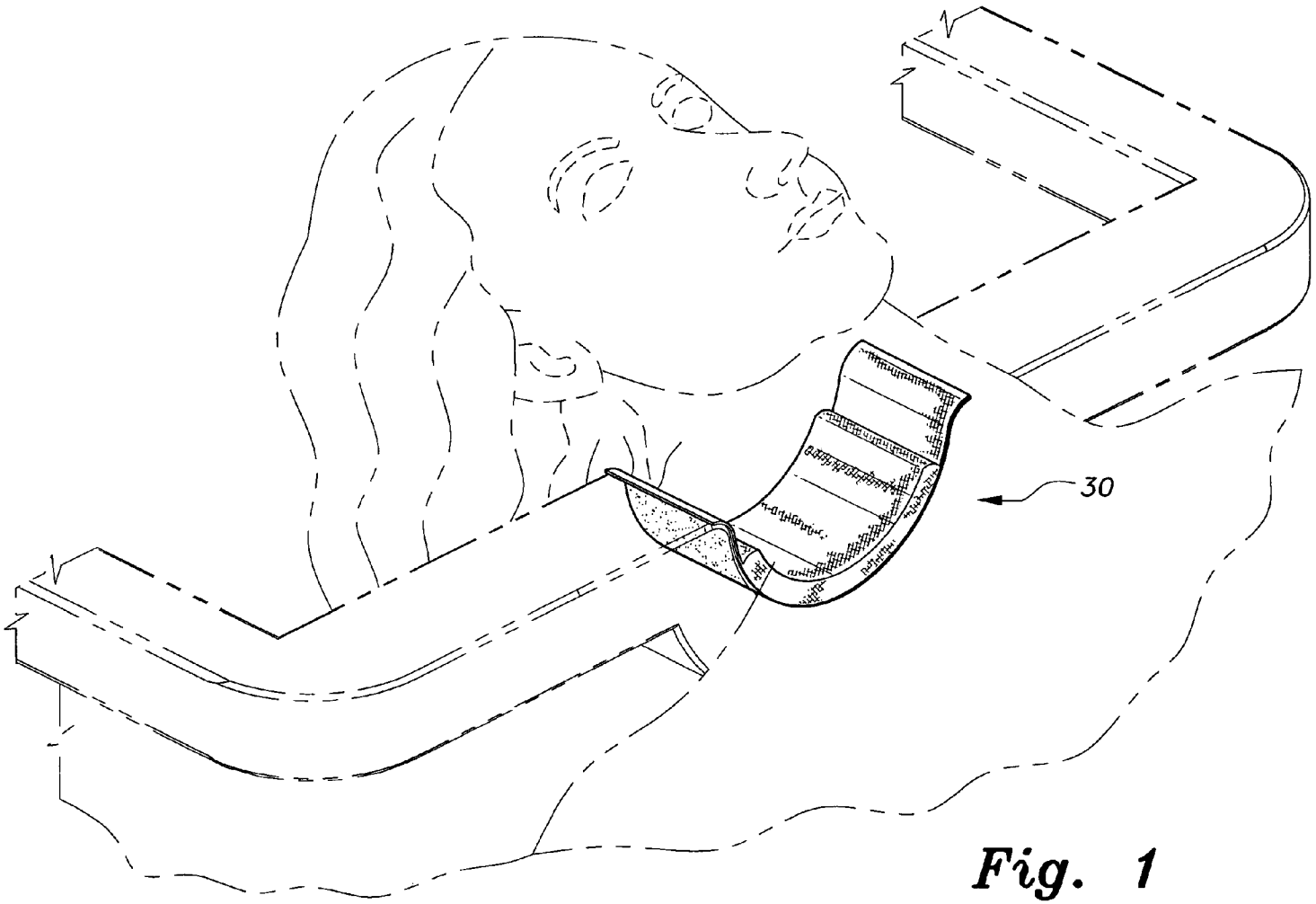
FIG. 1 is an environmental, perspective view of a first embodiment of a disposable neck pillow for shampoo basin according to the present invention.
Figure 2:
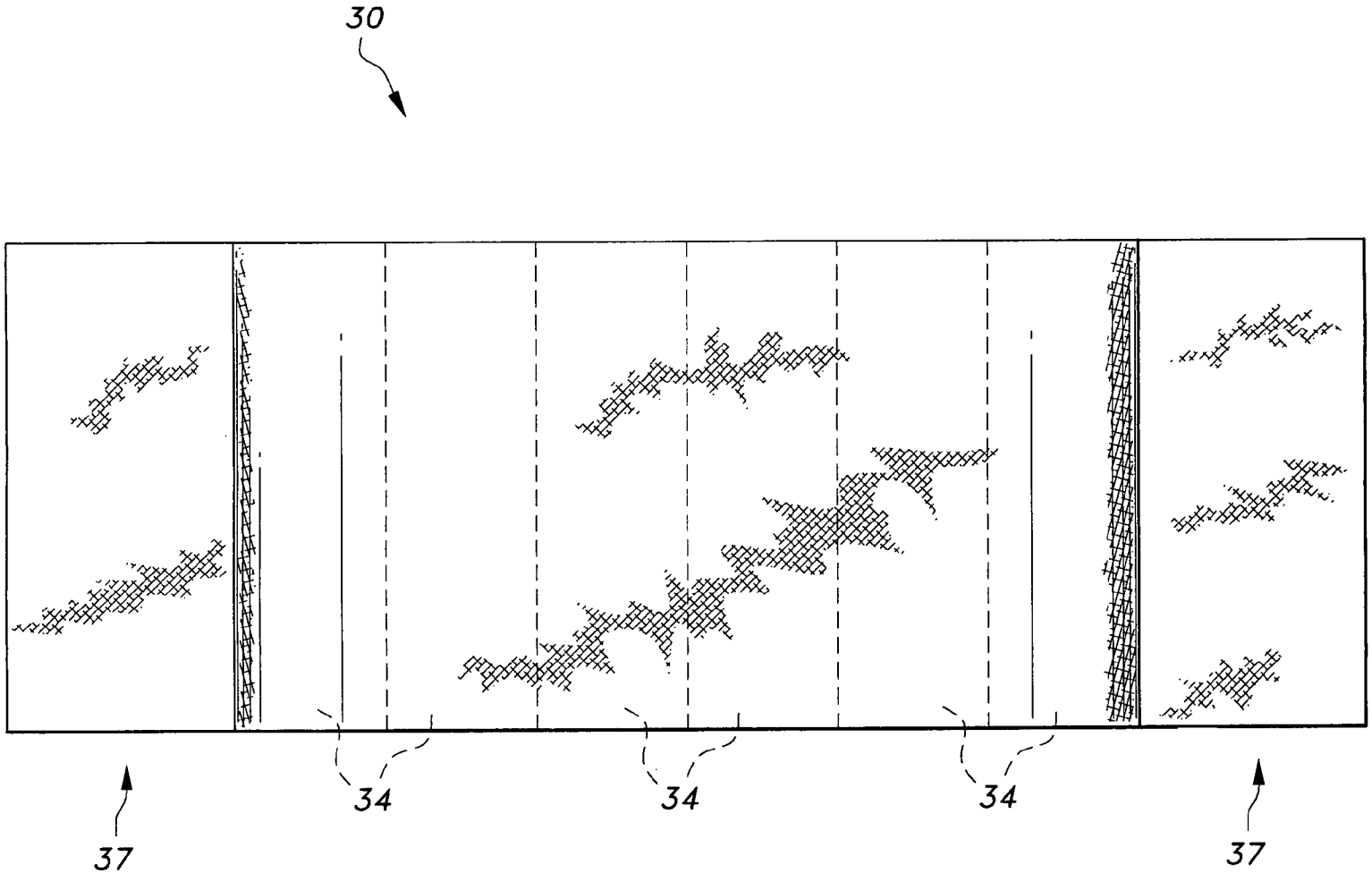
FIG. 2 is a top view of a first embodiment of disposable neck pillow for shampoo basin according to the present invention.
Figure 3:
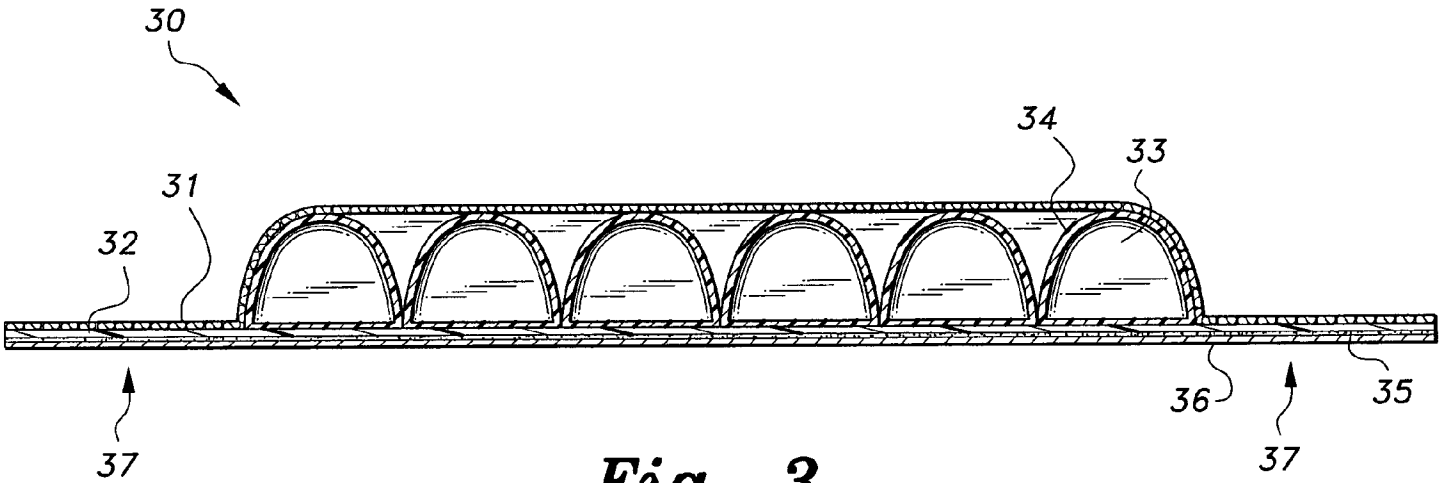
FIG. 3 is a side view in section of a first embodiment of a disposable neck pillow for shampoo basin according to the present invention.

As shown in FIG. 1, the disposable neck pillow 30 is a pillow or pad for a shampoo basin. As best seen in FIGS. 2-3, a first embodiment of the neck pillow/pad 30 has an outer top cover 31 and an outer bottom cover 32 made from a fabric or the like. A cushioning pad 33 is provided between the top 31 and bottom 32 covers. The cushioning pad 33 is comprised of one or more air pillows or bladders 34 joined together or otherwise positioned side-by-side if a plurality of bladders are utilized. For example, a 4-inch by 6-inch cushioning pad 33 may be comprised of six 1"×4"tubular bladders 34 joined together. As illustrated, each bladder is of a hemispherical cross-sectional configuration. It should be noted, however, that other suitable configurations could be employed. It should also be noted that the bladders 34 could be arranged in a spaced-apart relationship instead of the abutting relationship shown in the drawings. A suitable adhesive 35 is provided on the bottom cover. A removable release liner 36 is utilized to cover the adhesive 35 until the neck pillow 30 is ready to be affixed to the basin. Tabs 37 extend from each end of the cushioning pad 33 to provide additional surface area for adhering the neck pillow 30 to the basin.

Figure 4:
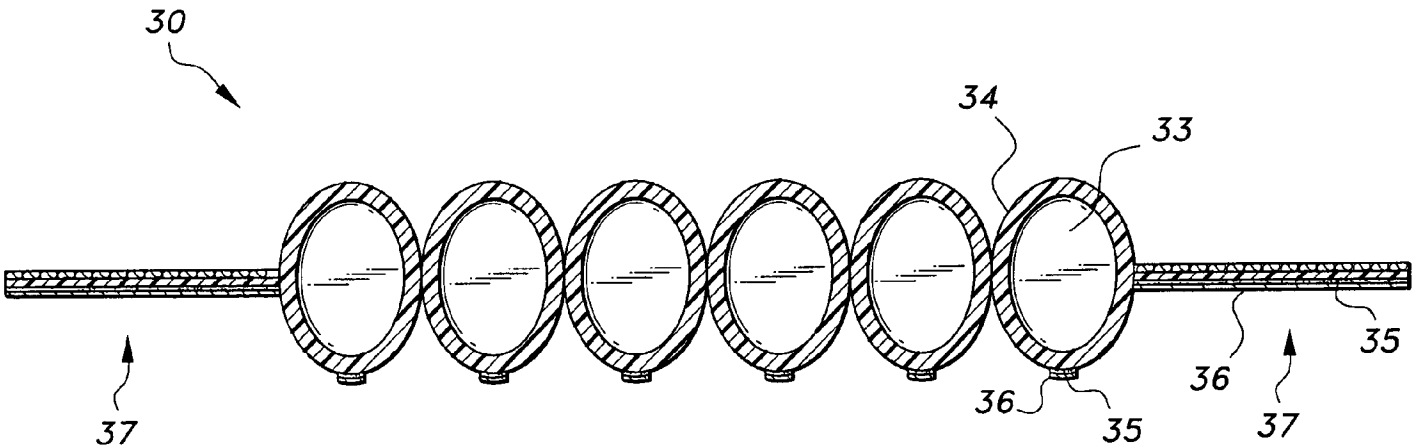
FIG. 4 is a side view in section of a second embodiment of a disposable neck pillow for shampoo basin according to the present invention.

In a second embodiment, shown in FIG. 4, the bladders 34 do not have common top or bottom covers. Each bladder 34 is of an ovate cross-sectional configuration. As noted above, other suitable configurations may be employed, and the bladders 34 may be spaced apart. Adhesive 35 and release paper 36 are fixed to each individual bladder 34. A tab 37 extends from the center of the outermost bladder at each end of the cushioning pad 33 for reasons as noted above.

Figure 5:
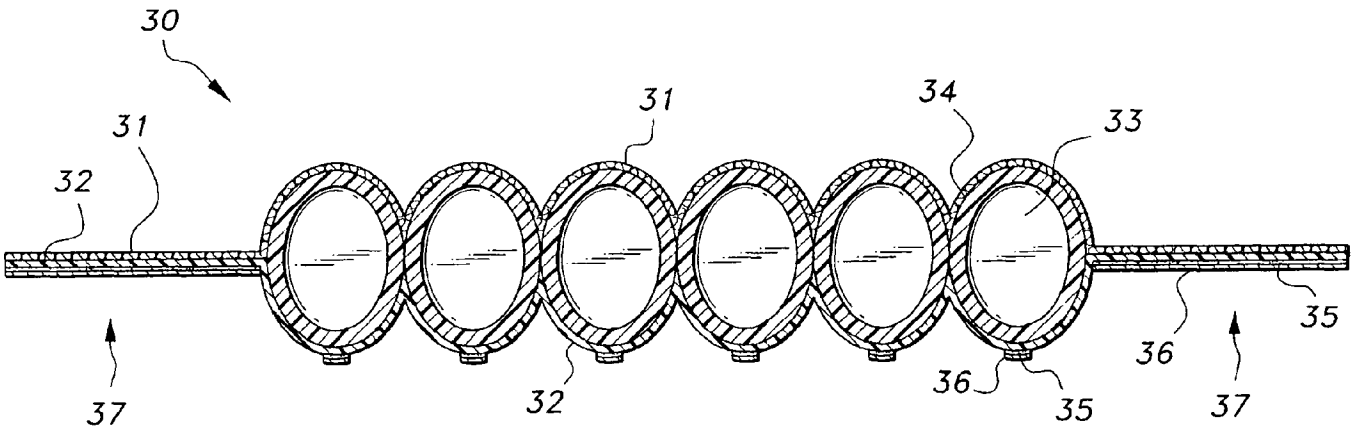
FIG. 5 is a side view in section of a third embodiment of a disposable neck pillow for shampoo basin according to the present invention.

The embodiment of the disposable neck pillow of FIG. 5 is constructed similarly to that of FIG. 4 in that the bladders 34 are of approximate ovate configuration or the like. However, unlike FIG. 4, this embodiment incorporates top and bottom covers 31, 32, wherein the covers 31, 32 encapsulate each bladder 34 in an individual manner. The adhesive 35 and release papers 36 are affixed to each bottom cover 32.

Figure 6:
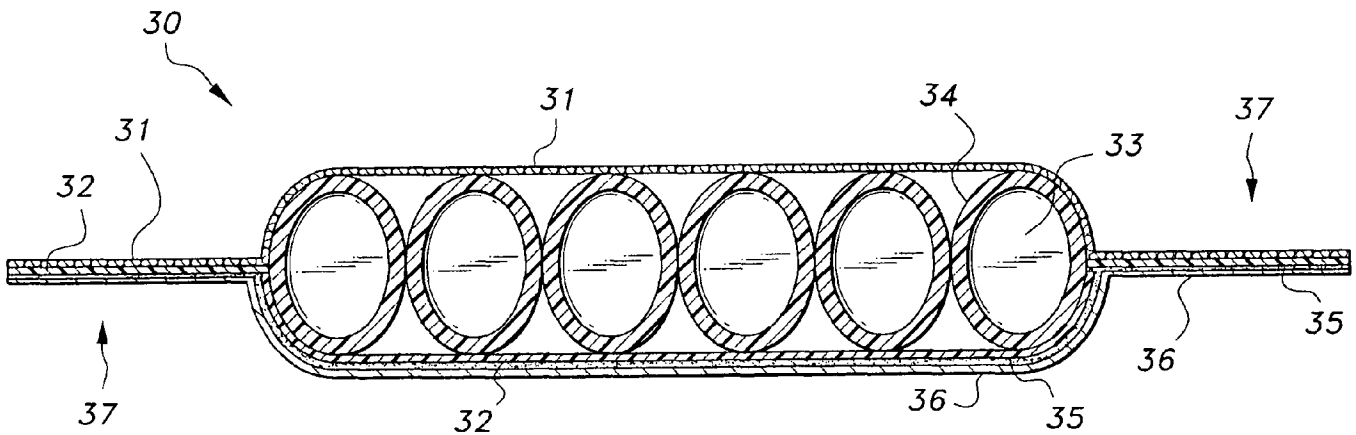
FIG. 6 is a side view in section of a fourth embodiment of a disposable neck pillow for shampoo basin according to the present invention.

The embodiment of the disposable neck pillow of FIG. 6 is an embodiment wherein the covers 31 and 32 envelop bladders 34 en masse, rather than individually, similar to FIG. 3 except for the shape of the bladders 34.

Figure 7:
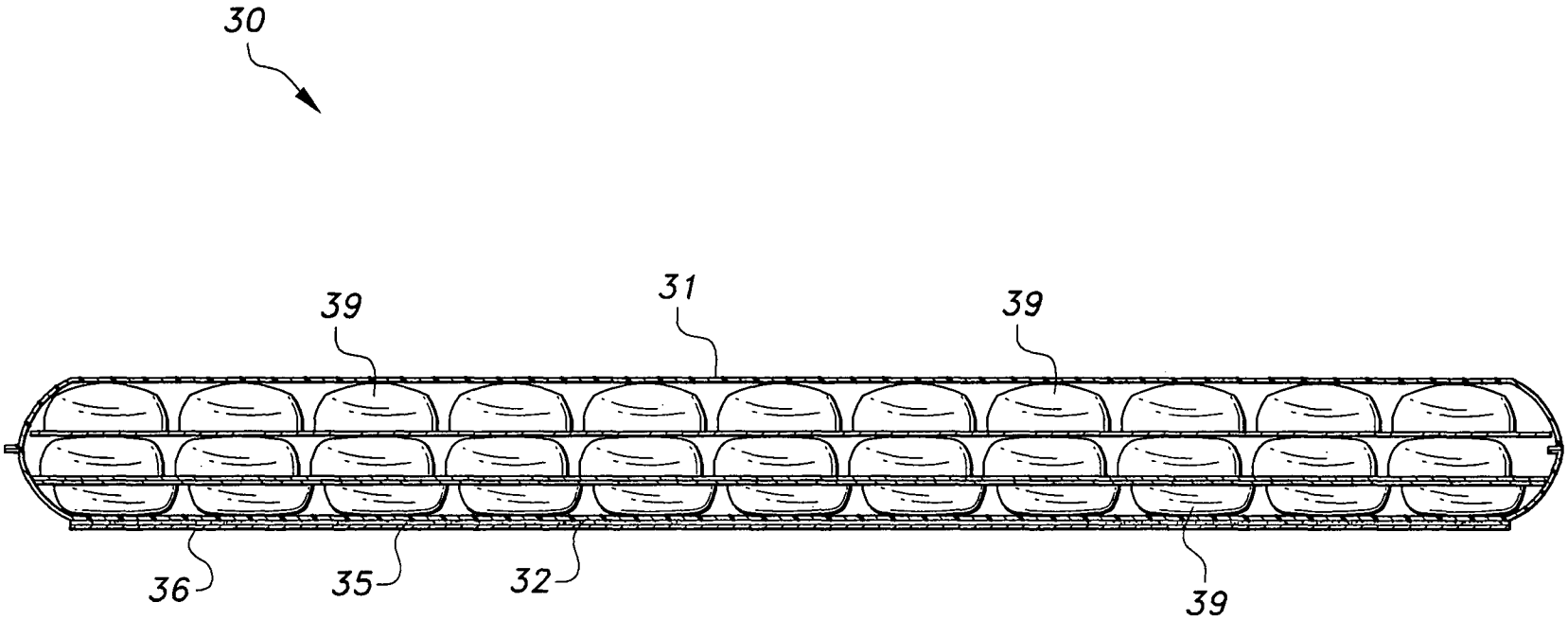
FIG. 7 is a side view in section of a fifth embodiment of a disposable neck pillow for shampoo basin according to the present invention.

FIG. 7 shows an embodiment of the neck pillow that employs ASTRO-CELL™ or BUBBLE WRAP™ 39 as the cushioning material. ASTRO-CELL™ and BUBBLE WRAP™ are air cellular cushioning materials. ASTRO-CELL™ or BUBBLE WRAP™ provides a relatively inexpensive and durable cushioning material for the disposable neck pillow/pad 30. As shown in the drawing, the cushioning material may include multiple sheets of material stacked in layers, each sheet having a plurality of plastic air bubbles or chambers on at least one surface thereof. The air bubbles in adjacent layers may be staggered or offset from one another, and the air bubbles in adjacent layers may face in the same direction or in opposite directions.

It is to be understood that the present invention is not limited to the embodiments described above, but encompasses any and all embodiments within the scope of the following claims.

We claim:

1. A rectangular disposable neck pillow for a shampoo basin, consisting of:

a flexible cushioning material consisting of three rectangularly-shaped sheets of material stacked in layers, each layer consisting of formed cushioning pockets located on at least one surface thereof and projecting outwardly therefrom, wherein the formed cushioning pockets of each adjacent layer are staggered from one another, the cushioning material extends substantially the entire length of the pillow;

a rectangularly-shaped top cover member;

a rectangularly-shaped bottom cover member having an inner surface and an outer surface, the top cover member and the bottom cover member encapsulating and totally sealing the cushioning material;

an adhesive layer disposed on substantially the entire outer surface of the bottom cover member for attaching the neck pillow to the shampoo basin; and a release paper removably covering the adhesive.

2. The disposable neck pillow according to claim 1, wherein said cushioning pockets are air-filled.

3. The disposable neck pillow according to claim 1, wherein said top cover member made from fabric material having a soft texture.

4. The disposable neck pillow according to claim 1, wherein said bottom cover member made from a liquid resistant material.

* * * * *